US006325559B1

(12) United States Patent
Kaiser et al.

(10) Patent No.: US 6,325,559 B1
(45) Date of Patent: Dec. 4, 2001

(54) SINGLE TRANSMISSION STATE MEDIA HANDLING FOR EJECTING, PICKING AND LOADING

(75) Inventors: Pierre J. Kaiser, Vancouver; Allan G. Olson, Camas; Matthew A. Shepherd, Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/587,490

(22) Filed: Jun. 2, 2000

(51) Int. Cl.[7] ..... B41J 11/58
(52) U.S. Cl. ..... 400/624; 347/104
(58) Field of Search ..... 400/624, 625, 400/628, 629, 635, 708; 347/104; 271/264, 272, 275, 109, 225

(56) References Cited

U.S. PATENT DOCUMENTS

| | | | | |
|---|---|---|---|---|
| 4,812,065 | * | 3/1989 | Shimogawara et al. | 400/624 |
| 5,080,515 | * | 1/1992 | Engelhardt et al. | 400/625 |
| 5,149,218 | * | 9/1992 | Iwatani et al. | 400/625 |
| 5,378,071 | * | 1/1995 | Uehara | 400/624 |
| 5,391,009 | * | 2/1995 | Studder | 400/625 |
| 5,419,543 | * | 5/1995 | Nakamura et al. | 347/104 |
| 5,624,196 | * | 4/1997 | Jackson et al. | 400/625 |
| 5,730,537 | * | 3/1998 | Kelly et al. | 347/104 |
| 5,772,343 | * | 6/1998 | Beretta et al. | 400/624 |
| 5,807,003 | * | 9/1998 | Kobayashi et al. | 400/625 |
| 5,890,821 | * | 4/1999 | Lesniak et al. | 400/625 |
| 6,007,194 | * | 12/1999 | Yokoyama et al. | 347/104 |
| 6,168,270 | * | 1/2001 | Saikawa et al. | 347/104 |

OTHER PUBLICATIONS

Commonly assigned U.S. Patent Application 09/311,919, entitled "Method And Apparatus For Multiplexed Wet–Dye Printing," pending.

* cited by examiner

*Primary Examiner*—Eugene Eickholt

(57) ABSTRACT

Time between recording print on one media sheet and a subsequent media sheet is substantially reduced by ejecting, picking and loading within a single transmission state. In a continuous feed mode multi-sheet job, individual media sheets are continuously picked and loaded. The leading edge of one media sheet is substantially adjacent to the trailing edge of the prior media sheet. A media support plate is maintained in a raised position during the entire continuous feed cycle. The support plate biases a paper stack into communication with a pick roller. As the trailing edge of one media sheet exits the media stack, the leading edge of the next media sheet is already in position for engagement with the pick roller. Upon completion of print recording, a media sheet is ejected into an output tray by accelerating the media sheet. Such acceleration is achieved while remaining in the single transmission state.

5 Claims, 2 Drawing Sheets

SINGLE TRANSMISSION STATE MEDIA HANDLING FOR EJECTING, PICKING AND LOADING

BACKGROUND OF THE INVENTION

This invention relates generally to media handling methods and apparatus, and more particularly to methods and apparatus for reducing the time to eject one media sheet and pick and load the next media sheet.

In print recording technologies, such as inkjet printing, factors which relate to print recording throughput include factors which affect the time to apply print to the media, and factors which affect the time in between applying print to one media sheet and applying print to the next media sheet. The time to record print to a single media sheet is related to the recording technology and the print mode being used. For example, for inkjet printing technologies, there are typically draft, normal and best modes. For a given print recording technology, the time in between applying print from one sheet to the next typically remains relatively constant regardless of the printing mode. Such "in-between" time is used to eject the finished page, pick the next page, and load such next page into position to receive print. The subject matter of this invention relates to reducing such "in-between" time.

In faster printing modes, such as the draft mode listed above, the "in-between" time typically is a significant percent of the total time required to complete a print job. A typical "in-between" time is approximately two seconds. For an exemplary draft print job which prints at 6 seconds per media sheet, one third of the throughput is due to this "in-between" time. In higher quality print modes the proportion of time is less. In general, however, "in-between time" is a significant source of the throughput activity of a print recording device, such as an inkjet print recording system. Accordingly, there is a need for a method and apparatus which reduces the time in between recording print to one media sheet and the next media sheet.

SUMMARY OF THE INVENTION

According to the invention, the time "in-between" recording print on one media sheet and a subsequent media sheet is substantially reduced by performing the operation for ejecting the one media sheet and the operations for picking and loading the next media sheet within a single transmission state. Performance of these operations within a single transmission state avoids the significant time required to switch transmission states.

According to one aspect of the invention, in a continuous feed mode of individual media sheets, media sheets are continuously picked and loaded during a multi-sheet print recording job. The leading edge of one media sheet is substantially adjacent to the trailing edge of the prior media sheet.

During continuous feed mode, a media support plate is maintained in a raised position during the entire print job. The support plate biases the paper stack into communication with a pick roller. As the trailing edge of one media sheet exits the media stack, the leading edge of the next media sheet is already in position for engagement with the pick roller.

In some embodiments, upon completion of print recording, a media sheet is ejected into an output tray by accelerating the media sheet. Such acceleration is achieved while remaining in the single transmission state.

One advantage of the invention is that the time to pick a media sheet and the time to eject a media sheet are substantially reduced. As a result, the time in between recording print to one media sheet and the next media sheet is reduced. Correspondingly, the throughput rate of the print recording system is increased. These and other aspects and advantages of the invention will be better understood by reference to the following detailed description taken in conjunction with the accompanying drawings.

DESCRIPTION OF SPECIFIC EMBODIMENTS

Overview

Reference is now made in detail to a specific embodiment of the present invention, which illustrates the best mode presently contemplated by the inventor for practicing the invention. Alternative embodiments are also briefly described as applicable. For convenience of explanation, the invention is described with an exemplary embodiment of an inkjet print recording system. Use of this exemplary embodiment is not intended to be a limitation on the scope of the invention nor should any such intention be implied. The term media sheet is used herein as being synonymous with all forms of print media in the state of the art, such as plain paper, special paper, transparencies, card-stock, envelopes, and the like.

Figure 1:
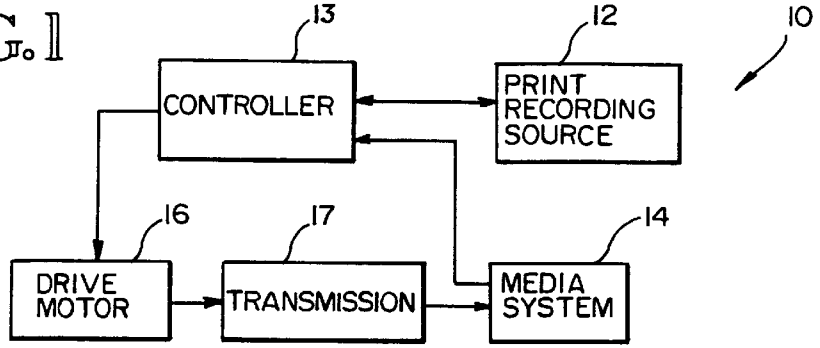
FIG. 1 is a block diagram of a print recording apparatus according to various embodiments of this invention.

Referring to FIG. 1, a print recording system 10 includes a print recording source 12, a media handling system 14, a drive motor 16, a transmission 17, and a controller 13. In operation the print recording system 10 receives a media sheet upon which text, graphics or other symbols are to be recorded. For example, in an inkjet printer embodiment the printer 10 receives a print job from a host computer (not shown). The controller 13 controls the drive motor 16 and print source 12 coordinating the movement of the media sheet relative to the print source 12. The media sheet is fed through the media handling system 14 adjacent to the print source 12 where the text, graphics or other symbols are recorded on the media sheet. The drive motor 16 generates a drive force coupled to the media handling system 14 through a transmission 17. In various embodiments the print recording system 10 serves as a computer printer, graphics plotter, copier machine, and/or a facsimile machine.

Figure 2:
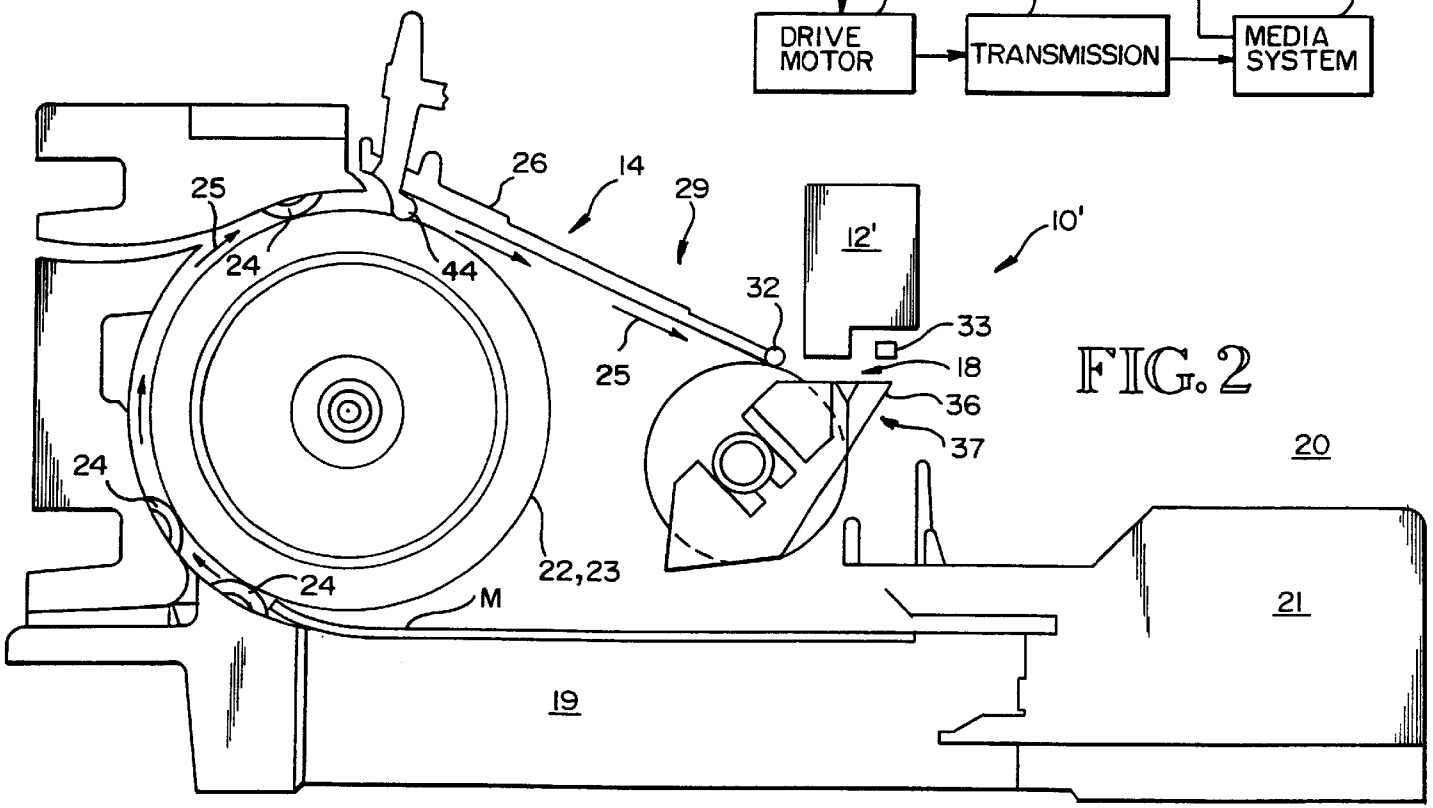
FIG. 2 is a planar view of a portion of one embodiment of the print recording apparatus of FIG. 1.

Referring to FIG. 2, the print recording source 12 and media handling system 14 are shown with an input tray 19 and an output tray 21 for an inkjet print recording system 10'. The print recording source is shown as an inkjet pen 12'. The media handling system 14 includes pick and feed rollers 22, 23, feed idler rollers 24, an upper feed guide 26, metering rollers 30, metering pinch rollers 32, and a print zone platform 36. A region between the print zone platform 36 and a printhead of the inkjet pen 12' is a print zone 18.

A media sheet M is picked from the input tray 19 by the pick roller 22. The pick and feed rollers 22, 23 rotate in a first direction feeding the media sheet M around the pick and feed rollers 22, 23 along a media path 25 (as depicted by the series of arrows labelled with part number 25). The pick and feed rollers 22, 23 and the metering rollers 30 are driven by the drive motor 16 via the transmission 17. The feed rollers 23 drive the media sheet M along the media path 25 to the metering rollers 30. As the media sheet 38 is fed around the pick and feed rollers 22, 23 the upper feed guide 26 directs the media sheet toward the metering rollers 30. The lead edge of the media sheet is captured between pinch rollers 32 and the metering rollers 30.

The metering rollers 30 meter the media sheet M through the print zone 18 and on into the output region 20. As the media sheet is metered through the print zone 18, ink is ejected from the inkjet pen 12' onto an area of the media sheet which is within the print zone 18. The media sheet M is supported within the print zone 18 by the print zone platform 36. In one embodiment the print zone platform 36 is a stationary device which remains in a fixed position during ejection of one media sheet and loading and printing to a next media sheet. In an alternative embodiment the print zone platform 36 is coupled to the metering roller 30 and moves between a raised position and a lowered position. The platform 36 is in the raised position during printing and is lowered to eject the media sheet M.

The media sheet is ejected from the print zone 18 after printing to the media sheet is complete. To do so the media sheet M is driven by the metering roller 30 along the media path 25 into an output region 20 above the output tray 21. In one embodiment the metering roller accelerates to "launch" the media sheet toward the output region 20. In an alternative embodiment a mechanical arm or lever kicks the media sheet from the print zone platform 36 into the output region 20 after the media sheet passes beyond the metering rollers 30.

In a continuous feed mode of operation for a multi-sheet print job the media handling system 14 picks one media sheet after another to achieve a series sequence of media sheets which move through the media path 25 into the print zone 18 and on into the output region 20. The lead edge of one media sheet is substantially adjacent to the trailing edge of the prior media sheet. In practice, there is a small gap between the media sheets which is used to discriminate between media sheets. Specifically, an edge detector 33 (see FIG. 2) senses the leading edge of a media sheet by sensing the change from gap to media sheet. The gap between media sheets is advantageous to accurately detect paper position. The actual gap width is dependent on the resolution capability of the edge detector device.

In one embodiment the edge detector 33 is an optical sensor, although other types of edge detectors are implemented in differing embodiments. In an exemplary embodiment the edge detector sensor is positioned in the vicinity of the print zone. In one embodiment, the sensor 33 is positioned downstream from the pinch rollers 32 (see FIGS. 1 and 2). In an alternative embodiment the sensor 33 is positioned upstream from the pinch rollers 32 or between pinch rollers 32. For example, an optical sensor is carried in one embodiment by a carriage in common with the inkjet pen 12'. In a specific embodiment of an optical sensor a light transmitter portion is positioned above the media path 25, while a light receiver portion is positioned below the media path 25. When a media sheet is between the transmitter and receiver, the sensor outputs one state to the controller 13. When a media sheet is not so positioned (such as during a gap between the trailing edge of one media sheet and the leading edge of a subsequent media sheet), the sensor outputs another state to the controller 13. In such an embodiment the gap between trailing edge of one sheet and leading edge of the next sheet may be very small or the media sheets may be slightly overlapping, so that the trailing edge and leading edge are substantially adjacent.

Single Transmission State Operation with Continuous Pick and Load

Figure 3:
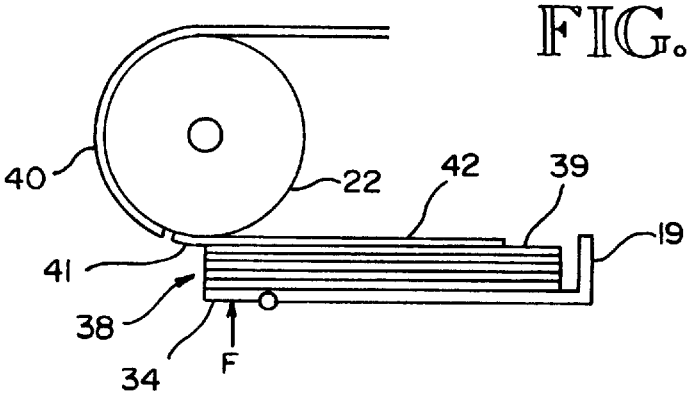
FIG. 3 is a planar view of a portion of the apparatus of FIG. 2 depicting continuous picking of media sheets according to an embodiment of this invention.

Referring to FIG. 3, the input tray 19 includes a bias plate 34 which underlies the media stack 39 over at least a portion of the length of the bottom media sheet. Such bias plate 34 exerts a bias force F on the portion 38 of the media stack 39 located toward the pick roller 22. Conventionally, a bias plate pivots between a raised position and a lowered position. The conventional bias plate is raised during a pick operation to elevate a portion of the media stack and bring the top sheet into contact which a picking device. During the continuous pick mode described herein, the bias plate 34 maintains the media stack portion 38 elevated with the top sheet in contact with the picking device. In one embodiment the bias plate is fixed in such position. In an alternative embodiment the bias plate moves between a raised position and a lowered position, and remains raised during the continuous pick mode of operation.

The effect of the bias plate 34 is to cause continuous picking of media sheets during a multi-sheet print job. As the trailing edge of one media sheet 40 passes from a pick ramp 41 adjacent the pick roller 22, the leading edge of the next media sheet 42 enters into contact with the pick roller 22 and is picked from the media stack 39. As a result, the leading edge of one media sheet 42 is substantially adjacent to the trailing edge of the prior media sheet 40, as the media sheets 40, 42 progress along the media path 25. Accordingly, continuous picking of a sequence of media sheets is achieved for a multisheet print job. This increases the print throughput by reducing the time attributable to empty space along the media path 25. The media path 25 is full for a greater portion of the print job compared to that for printing using the conventional delayed (or noncontinuous) picking operations.

Figure 4:
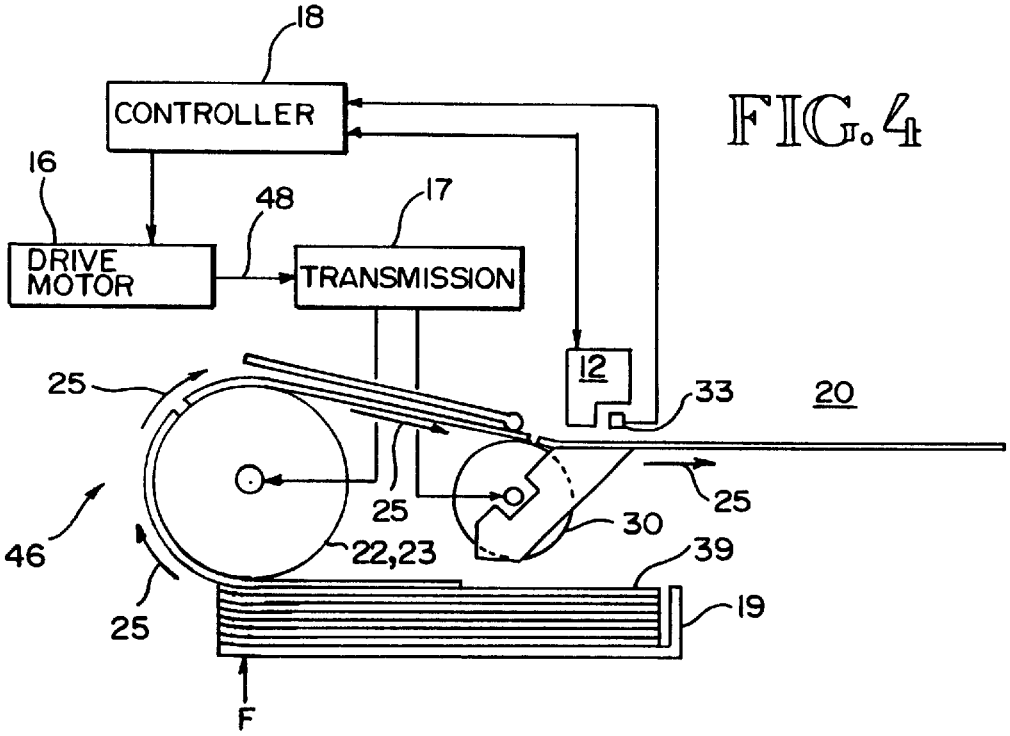
FIG. 4 is a planar view of a portion of the apparatus of FIGS. 1 and 2 showing a continuous stream of media sheets being printed according to an embodiment of this invention.

Referring to FIG. 4, the sequence 46 of media sheets move along the media path 25 toward and through the print zone 18 in response to a force exerted on the media sheets by a set of rollers. Such rollers include the pick and feed rollers 22, 23 and the metering rollers 30. The rollers 22, 23, 30 generate such force in response to a drive force 48 generated by the drive motor 16. The drive force 48 is coupled to the rollers 22, 23 and 30 —and ultimately to the media sheets—by the transmission 17. In conventional operations, the rollers 22, 23, 30 move in forward and reverse directions as needed. The transmission 17 changes gears and coupling, for example, to lift and lower the print zone platform 36. Further, the transmission conventionally may switch gears to drive the rollers 22, 23 at one speed and roller 30 at another speed.

Although, gear switching by the transmission 17 has functional advantages in some applications, such gear switching conventionally occupies a significant amount of time (e.g., on the order of 0.5 seconds). Consider, for example, a conventional draft print job which prints at 6 seconds per page, where 2 seconds per page is attributable to the time in between applying print to one media sheet and the next media sheet. Such gear switching can occupy 1.0 seconds of that 2 seconds. Accordingly, such gear switching can contribute significantly to the throughput limit for a print job. As it is desirable to increase throughput, there is an advantage gained in reducing or eliminating the time for gear switching. In a best mode embodiment of a continuous pick multi-sheet printing mode, the media handling system 14 operates the transmission 17 in a single transmission state. Specifically, the transmission 17 remains in the single transmission state for the picking, loading printing and ejection of one media sheet and on into the picking, loading, printing and ejection of the next media sheet.

The transmission 17 includes all mechanical linkage from a drive shaft of the drive motor 16 to the drive axle of the rollers 22, 23 and the drive axle of the rollers 30. Conventionally, a transmission includes one or more gears and may include a clutch mechanism. By single transmission state, it is meant that the transmission 17 does not switch out of gear (into idle) and does not switch gearing linkages. It does not mean that the motor remains at a constant speed.

It is contemplated that the drive motor 16 may change speeds. In a preferred embodiment the drive motor 16 changes speeds to effect ejection of the media sheet into the output region 20. For a stepper motor, the motor turns in incremental steps. For a DC motor close-loop control is implemented to achieve a sequence of pulsed movements. To achieve a constant velocity, each pulsed movement occurs with the same amplitude for the same duration at the same duty cycle. During printing the speed varies according to the print job. Typically, a media sheet is advanced, then a line of print is recorded, then the media is advanced by a line space, or a fraction of a line space, and the next line of print is recorded. The timing between advances varies according to the print job. Image graphics printing, for example, generally takes longer than text printing. It is after printing to a media sheet is complete that concerns the methods described herein for improving throughput.

When the media sheet reaches the bottom margin for printing the media sheet is moved by the metering roller further into the output region 20. Typically, a kicker device applies a pushing force to the trailing edge of the media sheet to eject the media sheet the rest of the way into the output region 20. In a noncontinuous mode where there is a asignificant gap between media sheets, such kicking method is implemented. However, in continuous mode when there is not a substantial space between the media sheets another method is adopted to effectively eject the media sheet. In one embodiment, the controller 13 signals the drive motor 16 when there is no more print to be recorded on the media sheet. In response the motor increase the drive force to accelerate movement of the media sheets. Of interest is the media sheet with a trailing portion still under the metering roller 30. By accelerating the drive force this media sheet is launched from the metering roller and print zone into the output regions 20 when leaving contact with the metering roller 30. In a preferred embodiment the launching is controlled so as not to apply too large of a force to the media sheet.

Figure 5:
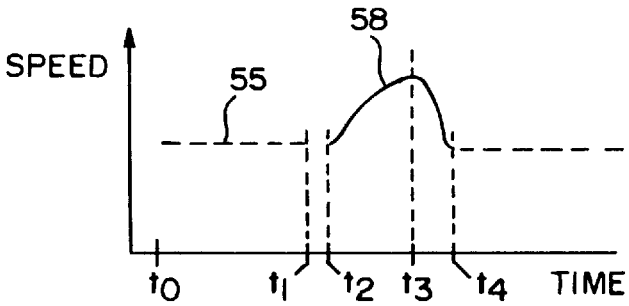
FIG. 5 is a graph showing motor speed along a y-axis and time along an x-axis for the drive motor of FIGS. 1, 2 and 4 according to an embodiment of this invention.

Referring to FIG. 5, the speed magnitudes achieved by a series of drive motor actions is shown during a printing operation for a DC motor or a stepper motor embodiment. Recording of print to a media sheet occurs during stationary phases within the time period from time $t_o$ to time $t_l$. In actuality, these no movement phases are substantially longer than the movement phases depicted by the magnitudes 55. Between time $t_j$ and $t_2$, the controller determines that the printing to the current media sheet is complete. As a result, the controller sends a signal to the drive motor 16. In some embodiments, the controller, may signal the drive motor to advance the media sheet at a normal speed until a certain trailing length is reached. At such time the controller then signals the motor to accelerate the media sheet. FIG. 5 depicts the immediate acceleration of the media sheet trailing portion. Specifically, from time $t_2$ to time $t_3$ the drive motor 16 increases the drive force to accelerate the rotation of the metering rollers 30 (the rollers 22, 23 also are effected in this embodiment). As a result, the current media sheet advancing through the print zone accelerates at an increasing speed 58 depicted by the waveform segment 58. Upon departing contact with the metering roller 30 the media sheet launches into the output region 20. From times $t_3$ to $t_4$ the drive motor 16 reduces the drive force 48 as the next media sheet is advanced into the print zone by its page margin to get ready to receive print recording. From time $t_4$ onwards the next media sheet receives print recording, as the cycle repeats.

In some embodiments it is undesirable to be at the accelerated speed during picking. However, in a best mode embodiment the accelerated speed is not so fast as to hinder the picking process. Also, for standard paper sizes the media handling system geometry of a best mode embodiment is such that picking is not occurring during the accelerated speed phase.

Meritorious and Advantageous Effects

One advantage of the invention is that the time to pick a media sheet and the time to eject a media sheet are substantially reduced. As a result, the time in between recording print to one media sheet and the next media sheet is reduced. Correspondingly, the throughput rate of the print recording system is increased.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for handling media sheets in a multi-sheet print recording job, comprising the steps of:

coupling a drive force through a transmission linkage to a set of media handling rollers;

ejecting, picking and loading a continuous stream of individual media sheets in response to the drive force, wherein the transmission linkage remains in a single transmission state, and wherein the drive force acts upon each one sheet of the plurality of media sheets as said one sheet engages a roller of the set of media handling rollers, in which said ejecting comprises accelerating motion of a current media sheet after said current media sheet receives print recording.

2. The method of claim 1, in which motion of the current media sheet is accelerated by a roller in contact with the media sheet, and wherein once contact between the roller and the media sheet is discontinued, the current media sheet continues toward an output region based upon an inertia of the current media sheet.

3. A method for handling media sheets in a multi-sheet print recording job, comprising the steps of:

continuously picking a media sheet from a stack to achieve a sequence of media sheets, wherein the leading edge of one media sheet is substantially adjacent to the trailing edge of a prior media sheet;

advancing the sequence of media sheets, wherein a first media sheet is advanced into a print recording region to receive print recording;

ejecting the first media sheet into an output region after said print recording, in which the step of ejecting comprises accelerating motion of the first media sheet in response to the drive force after said print recording; and maintaining a transmission in a single transmission state during the steps of continuously picking, advancing and ejecting, wherein the transmission couples a driving force which affects the steps of picking and advancing.

4. The method of claim 3, in which the drive force is applied to the current media sheet by a roller in contact with the media sheet, and wherein once contact between the roller and the media sheet is discontinued, the current media sheet continues toward an output region based upon an inertia of the current media sheet.

5. A print recording system, comprising:

a print recording apparatus;

a support surface for supporting a stack of individual media sheets;

a pick roller for picking a first media sheet from the stack in response to a drive force;

a feed roller for advancing the first media sheet, in response to the drive force, into an area to receive print recording from the print recording device;

an output region into which the first media sheet is ejected, in response to the drive force, after receiving print recording;

a transmission communicating the drive force while remaining in a single transmission state during ejection of the first media sheet and picking and advancing of a subsequent media sheet;

a motor coupled to the transmission, the motor generating the drive force; and a controller coupled to the motor, the controller signalling the motor to increase the drive force temporarily to accelerate ejection of the first media sheet into the output region.

* * * * *